US007121714B2

(12) United States Patent
Parker Metcalfe, III et al.

(10) Patent No.: US 7,121,714 B2
(45) Date of Patent: Oct. 17, 2006

(54) FLUID MIXER UTILIZING VISCOUS DRAG

(75) Inventors: Guy Parker Metcalfe, III, Victoria (AU); Murray Rudman, Victoria (AU)

(73) Assignee: Commonwealth Scientific and Industrial Research Organisation, Australian Capital Territory (AU)

( * ) Notice: Subject to any disclaimer, the term of this patent is extended or adjusted under 35 U.S.C. 154(b) by 96 days.

(21) Appl. No.: 10/363,920

(22) PCT Filed: Sep. 7, 2001

(86) PCT No.: PCT/AU01/01127

§ 371 (c)(1),
(2), (4) Date: Aug. 8, 2003

(87) PCT Pub. No.: WO02/20144

PCT Pub. Date: Mar. 14, 2002

(65) Prior Publication Data

US 2004/0013034 A1 Jan. 22, 2004

Related U.S. Application Data

(60) Provisional application No. 60/231,358, filed on Sep. 8, 2000.

(51) Int. Cl.
*B01F 5/06* (2006.01)
*B01F 9/02* (2006.01)

(52) U.S. Cl. ..... 366/175.1; 366/226; 366/230; 366/305; 366/338

(58) Field of Classification Search ..... 366/175.1, 366/175.3, 181.5, 226, 230–231, 176.1, 305, 366/336–340

See application file for complete search history.

(56) References Cited

U.S. PATENT DOCUMENTS

| | | | | |
|---|---|---|---|---|
| 2,747,844 | A * | 5/1956 | Slayter | 366/336 |
| 4,482,254 | A | 11/1984 | Kessler et al. | |
| 4,599,208 | A | 7/1986 | Blaak | |
| 4,886,368 | A * | 12/1989 | King | 366/340 |
| 4,915,509 | A | 4/1990 | Sauer et al. | |
| 5,205,647 | A | 4/1993 | Ricciardi | |
| 5,333,952 | A * | 8/1994 | Perdue | 366/336 |
| 5,450,368 | A | 9/1995 | Kubota | |

(Continued)

FOREIGN PATENT DOCUMENTS

DE 3634254 A1 * 4/1988

(Continued)

OTHER PUBLICATIONS

Derwent Abstract Accession No. 98-163048/15, JP 10029213 A (Dow Corning Toray Silicone), Feb. 3, 1998.

*Primary Examiner*—Charles E. Cooley
(74) *Attorney, Agent, or Firm*—Sughrue Mion, PLLC

(57) ABSTRACT

A fluid mixer including an inner fluid flow (11) duct having a cylindrical wall (14) provided with the window openings (13) and an outer tubular sleeve (12) disposed outside and extending along the duct (11) to cover the openings (13). Fluids to be mixed are admitted to one end of duct (11) through an inlet (25) and the mixture flows out through outlet (32). Duct (11) is statically mounted in pedestals (15) fixed to a base platform (17). Sleeve (12) is mounted for rotation in further pedestals (16) and driven by motor (23) and drive belt (22) to rotate concentrically about duct (11) such that parts of the sleeve move across the window openings (13) to create viscous drag on fluid flowing through the duct and transverse flows of fluid in the regions of the openings to promote mixing.

22 Claims, 6 Drawing Sheets

U.S. PATENT DOCUMENTS

| | | | | |
|---|---|---|---|---|
| 5,538,343 | A * | 7/1996 | Tynan | 366/305 |
| 5,597,236 | A * | 1/1997 | Fasano | 366/338 |
| 6,074,085 | A * | 6/2000 | Scarpa et al. | 366/101 |
| 6,386,751 | B1 * | 5/2002 | Wootan et al. | |
| 2004/0013034 | A1 * | 1/2004 | Metcalfe, III et al. | 366/230 |

FOREIGN PATENT DOCUMENTS

| | | | |
|---|---|---|---|
| EP | 0065685 | * | 12/1982 |
| EP | 0401614 A1 | * | 12/1990 |
| EP | 620039 A | | 10/1994 |

* cited by examiner

FLUID MIXER UTILIZING VISCOUS DRAG

This is a National Stage entry of application Ser. No. PCT/AU01/01127 filed Sep. 7, 2001, of which the claim for priority was based on provisional application 60/231,358 filed Sep. 8, 2000; the disclosure of which is incorporated herein by reference.

TECHNICAL FIELD

The present invention relates to fluid mixers and more generally to techniques for mixing materials within fluids.

Typical static mixers are characterised by baffles, plates and constrictions that result in regions of high shear and material build-up. On the other hand, stirred tank mixers can suffer from large stagnant regions and if viscous fluids are involved, consumption of energy can be significant. Stirred tank mixers are also normally characterised by regions of high shear.

The regions of high shear may destroy delicate products or reagents, for example, the biological reagents involved in viscous fermentations. Similarly, regions of high shear may produce dangerous situations when mixing small prills of explosives in a delicate but viscous fuel gel. Regions of high shear may also disrupt the formation and growth of particles or aggregates in a crystalliser. Alternatively, fibrous pulp suspensions may catch on the baffles or plates of a static mixer.

The present invention provides an alternative form of mixer and a new mixing technique whereby a material can be mixed in a fluid in a manner which promotes effective mixing without excessive consumption of energy or the generation of excessive shear forces.

DISCLOSURE OF THE INVENTION

According to the invention there is provided a mixer comprising:

an elongate fluid flow duct having a peripheral wall provided with a series of openings;

an outer sleeve disposed outside and extending along the duct to cover said openings in the wall of the fluid flow duct;

a duct inlet for admission into one end of the duct and consequent flow along and within the duct of a fluid and a material to be mixed with that fluid to form a mixture thereof;

a duct outlet for outlet of the mixture from the duct;

a drive means operable to impart relative motion between the duct and the sleeve such that parts of the sleeve move across the openings in the peripheral wall of the duct to create viscous drag on the fluid and tranverse flows of fluid within the duct in the regions of the openings whereby to promote mixing of said material in the fluid as they flow within and through the duct.

The duct and outer sleeve may be concentric cylindrical formation and the drive means may be operable to impart relative rotation between the duct and the outer sleeve. More particularly, the duct may be static with the sleeve mounted for rotation about the duct and the drive means may be operable to rotate the outer sleeve concentrically about the duct.

The openings may be in the form of arcuate windows each extending circumferentially of the duct.

The windows may be of constant width and be disposed in an array in which successive windows are staggered both longitudinally and circumferentialy of the duct.

The invention also provides a method of mixing a material in a fluid comprising:

locating a fluid flow duct having a duct wall perforated by a series of openings within an outer sleeve which covers the duct wall openings;

passing fluid and material to be mixed therewith through the duct; and imparting relative motion between the duct and the sleeve such that parts of the sleeve move across the openings in the duct wall to create viscous drag on the fluid flowing through the duct and transverse flows of the fluid in the vicinity of the duct openings whereby to promote mixing of said material in the fluid.

In a preferred embodiment, the duct and the movable sleeve are cylindrical, the outer diameter of the inner cylinder is as close as practicable to the inner diameter of the outer cylinder and the outer cylinder is rotatable with respect to the inner cylinder.

In operation the duct is maintained in a stationary mode and has a number of windows cut into its wall. The sleeve is mechanically moved with respect to the duct. The materials to be mixed or dispersed are fed into one end of the duct and pumped through it as the outer sleeve is moved with respect to the duct. The viscous drag from the outer sleeve, which acts on the fluid in the region of each window, sets up a secondary (tranverse) flow in the fluid. The non-window parts of the duct isolate the flow from the viscous drag of the outer sleeve in all regions except the windows. This ensures that the flow does not move simply as a solid body and ensures that the transverse flow within each window region is not axi-symmetric. Thus, as the flow passes from the influence of one window to the influence of the next, the flow experiences different shearing and stretching orientations. It is this programmed sequence of flow reorientation and stretchin that causes good mixing.

The material for mixing with the fluid in the mixer of the present invention may be another fluid. It may also be minute bubbles of gas. It could also be solid particles for dissolution in a fluid or for the purpose of forming a slurry.

BRIEF DESCRIPTION OF THE DRAWINGS

In order that the invention may be more fully explained, the relevant design principles and a presently preferred design will be described in some detail with reference to the accompanying drawings, in which.

DETAILED DESCRIPTION OF THE PREFERRED EMBODIMENT

Figure 1:
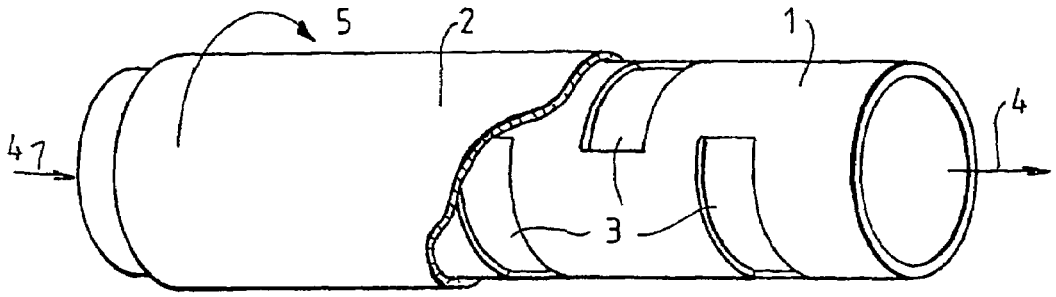
FIG. 1 is a diagrammatic representation of essential components of a cylindrical rotated arc mixer (RAM) operating in accordance with the invention.

FIG. 1 depicts a stationary inner cylinder 1 surrounded by an outer rotatable cylinder 2. The inner cylinder 1 has windows 3 cut into its wall. Fluids to be mixed are passed through the inner cylinder 1 in the direction of arrow 4 and the rotatable outer cylinder 2 is rotated in the direction indicated by the arrow 5. For convenience, rotation in an anticlockwise direction is accorded a positive angular velocity and rotation in a clockwise direction is accorded a negative angular velocity in subsequent description.

Figure 2:
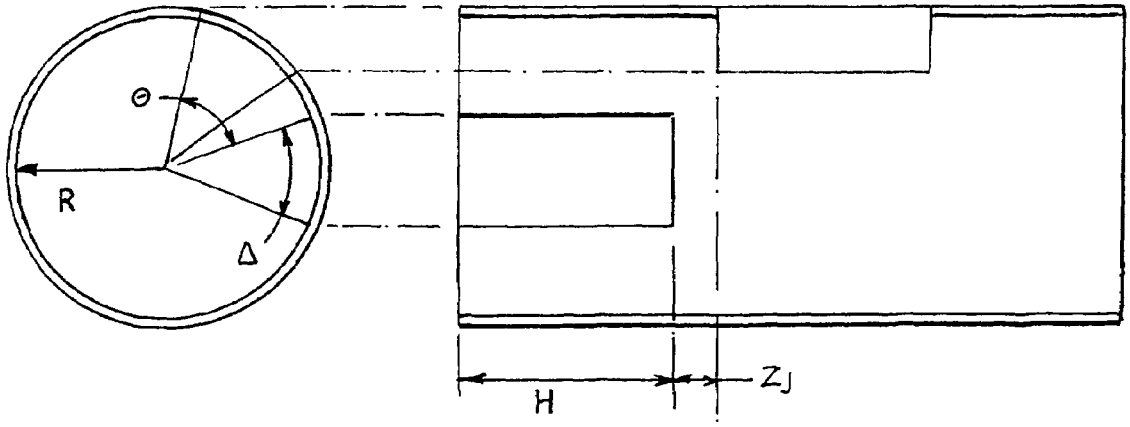
FIG. 2 is a further diagrammatic representation setting out significant design parameters of the mixer.
Figure 3:
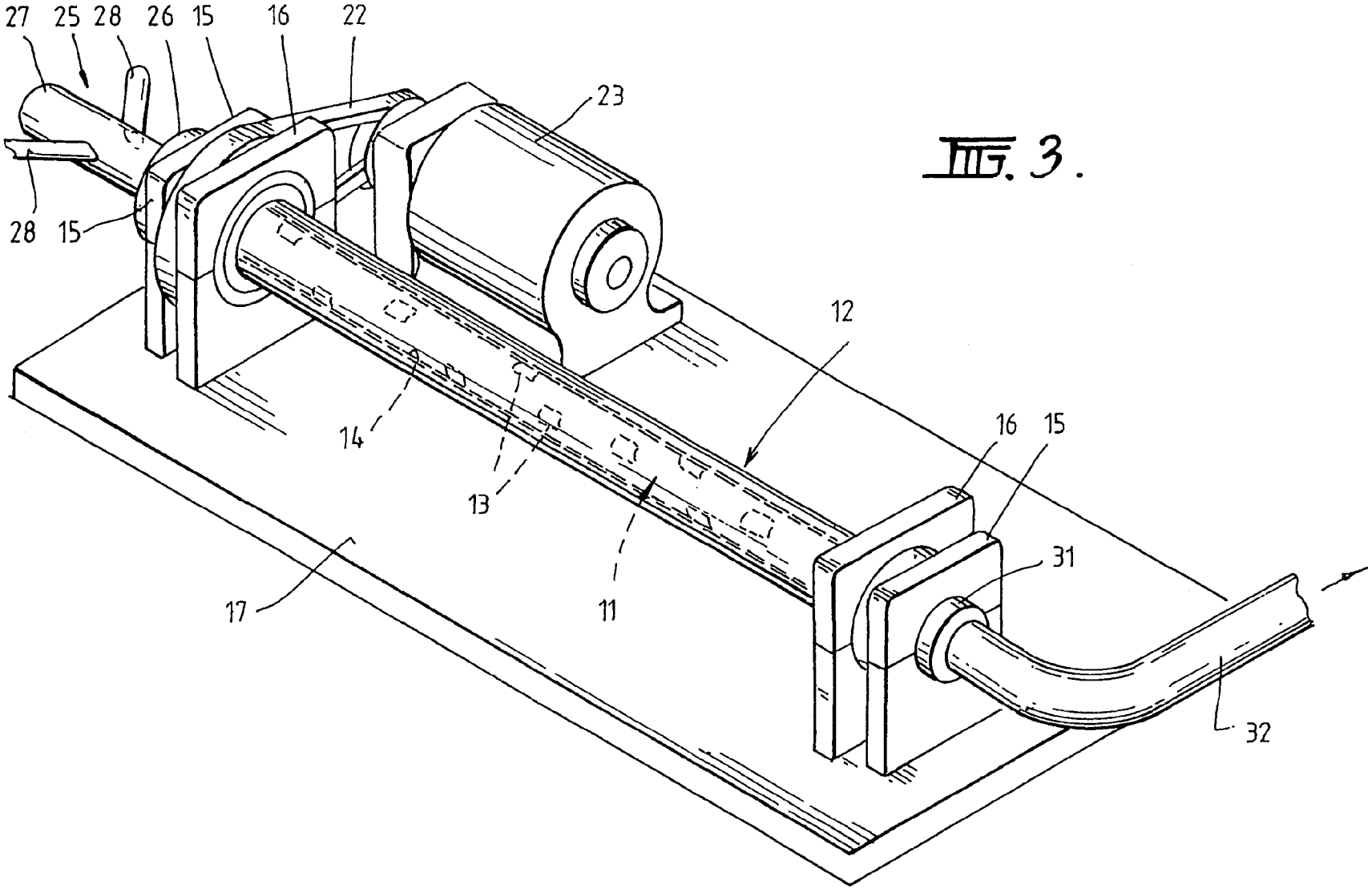
FIG. 3 is a perspective view of a presently preferred form of mixer constructed in accordance with the invention.
Figure 4:
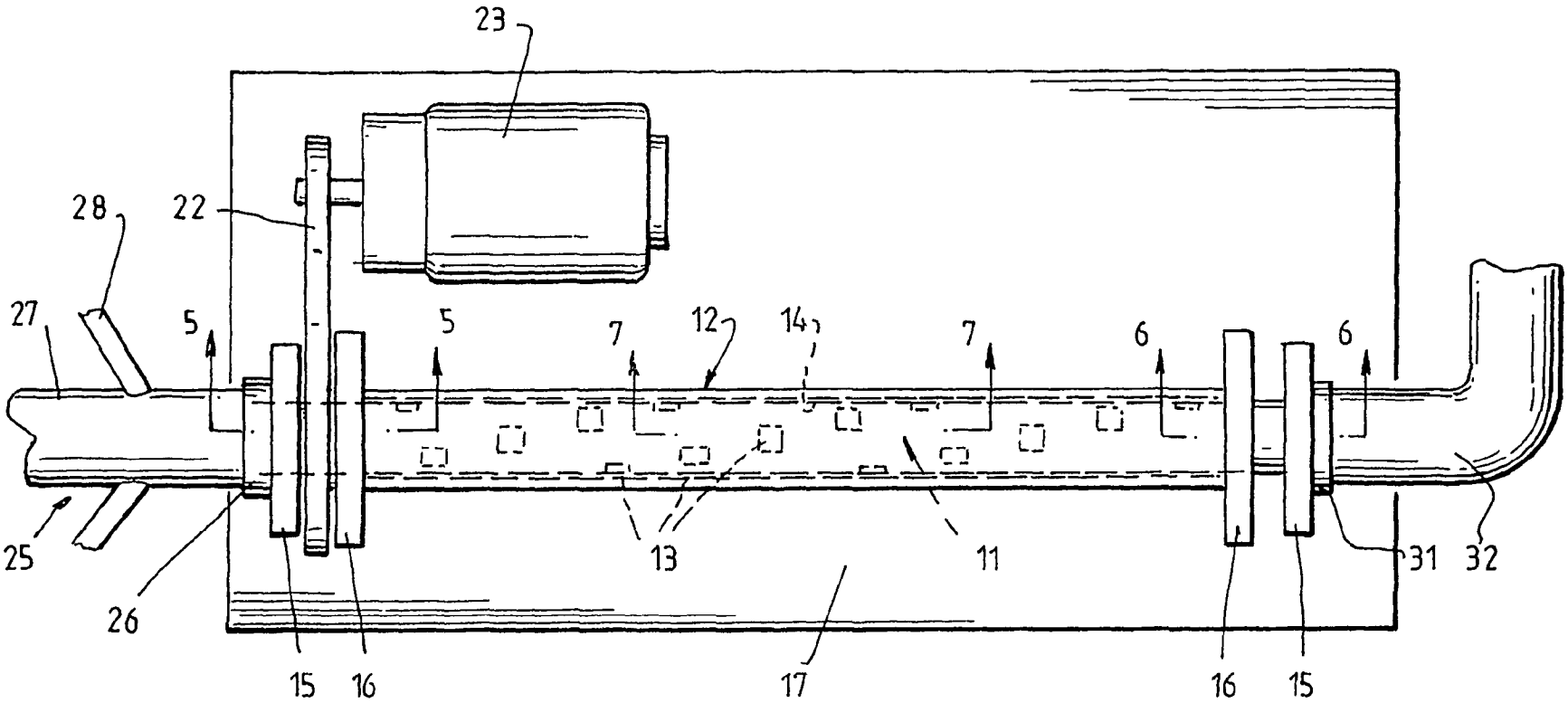
FIG. 4 is a plan view of essential components of the mixer shown in FIG. 3.
Figure 6:
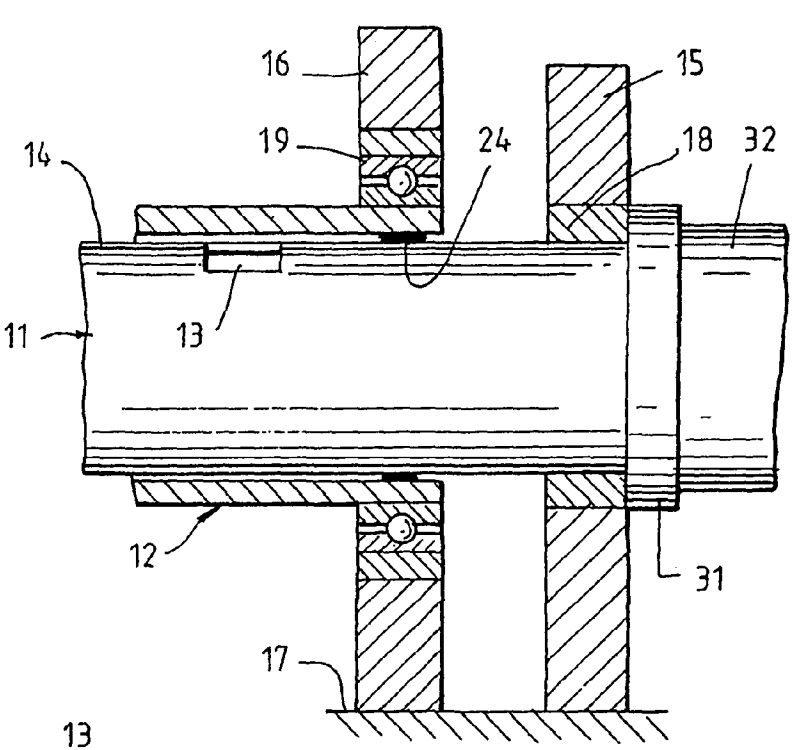
FIG. 6 is a vertical cross-section on the line 6—6 in FIG. 4.
Figure 5:
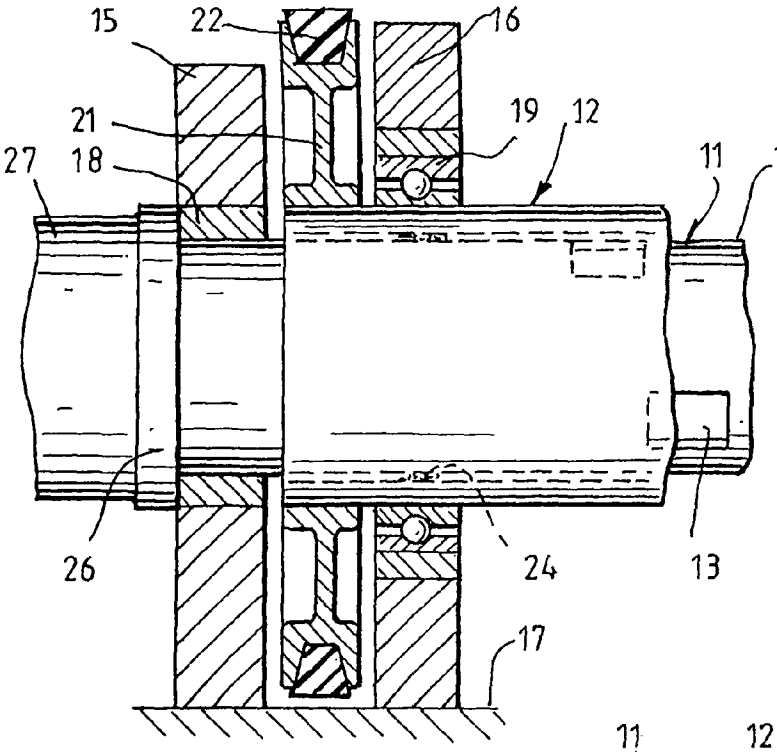
FIG. 5 is a vertical cross-section on the line 5—5 in FIG. 4.
Figure 7:
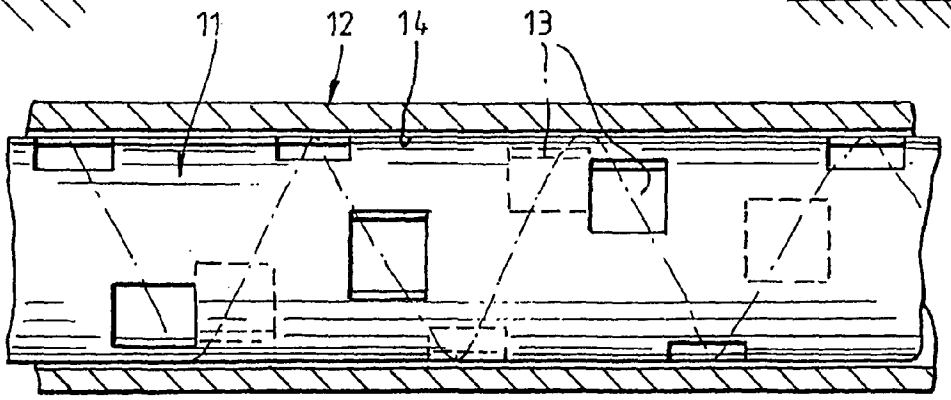
FIG. 7 is a cross-section on the line 7—7 in FIG. 4.

As shown in FIG. 2, the geometric design parameters of the mixer are as follows:

(i) R—The nominal radius of the RAM (meters) is the inner radius of the conduit (ii) Δ—The angular opening of each window (radians)

(iii) Θ—The angular offset between subsequent windows (angle from the start of one window to the start of the subsequent window, radians)

(iv) H—The axial extent of each window (meters)

(v) $Z_J$—The axial window gap, or distance from the end of one window to the start of the next (can be negative, meters)

(vi) N—The number of windows.

In addition to the geometric parameters, there are several operational parameters:

(i) W—The superficial (mean) axial flow velocity (m $sec^{-1}$)

(ii) Ω—The angular velocity of the outer RAM cylinder (rad $sec^{-1}$)

(iii) β—The ration of axial to rotational time scales (β=HΩ/W) (dimensionless).

Only two of these operational parameters are independent.

Finally, there are one or more dimensionless flow parameters that are a function of the fluid properties and flow conditions. For example, for Newtonian fluids, axial and rotational flow Reynolds numbers are, $$\mathrm{Re}_{ax} = \frac{2\rho WR}{\mu} \text{ and } \mathrm{Re}_{az} = \frac{\rho\Omega R^2}{\mu}.$$

These are related to Ω and W and their values may affect the choice of RAM parameters for optimum mixing.

For non-Newtonian fluids there will be other non-dimensional parameters that will be relevant, e.g. the Bingham number for psuedo-plastic fluids, the Deborah number for visco-elastic fluids, etc. The fluid parameters interact with the RAM's geometric and operational parameters in that RAM parameters can be adjusted, or tuned, for optimum mixing for each set of fluid parameters.

The RAM's geometric and operational specifications are dependent on the rheology of the fluid, the required volumetric through-flow rate, desired shear rate range and factors such as pumping energy, available space, etc. The basic procedure for determining the required RAM parameters is as follows: (Note that steps (ii), (iii) and (iv) are closely coupled and may need to be iterated a number of times to obtain the best mixing)

(i) Given the space and pumping constraints, fluid rheology, desired volumetric flow rate and desired shear rate range (if important) the radius, R, and the volumetric flow rate (characterised by W) can be determined.

(ii) Based primarily on fluid rheology, specify the window opening, Δ.

(iii) Factors such as fluid rheology, space requirements, pumping energy, shear rate etc. will then determine the choice of H and Ω (for example whether the rotation rate is low and the windows are long, or whether the rotation rate is high and the windows are short). H and Ω are chosen in conjunction with W and R to obtain a suitable value of β.

(iv) Once Δ and β are specified, the angular offset Θ is specified to ensure good mixing.

(v) The axial window gap $Z_J$is then specified, and is determined primarily by Θ and engineering constraints.

(vi) Finally the number of windows, N, is specified based on the operation mode of the RAM (in-line, batch) and the desired outcome of the mixing process.

An optimum selection of the parameters Δ, β and Θ cannot be determined directly from the fluid parameters alone—the design protocol outlined above or an equivalent should be followed. As part of this process, the parameter space must be systematically searched using a sequence of increasingly more mathematically sophisticated and computationally expensive design algorithms. This procedure ultimately leads to a small subset of the full parameter space in which good mixing occurs. Once this subset is found, the differences in mixing between close neighbouring points within the subset is small enough to be ignored. Thus any set of parameters within this small subset will result in good mixing. For a given application, more than one subset of good mixing parameters may exist, and the design procedure will locate all such subsets. Between each of these good mixing subsets, large regions of parameter space lie in which non-uniform and poor mixing occur. For a particular application there may be non-mixing factors which make a particular choice of one of the parameters desirable. In such cases, it will often be possible to find suitable values of the other parameters that lie within one of the good mixing subsets of the parameter space and which will still ensure good mixing.

FIGS. 3 to 7 illustrate a preferred form of rotary arc mixer constructed in accordance with the invention. That mixer comprises an inner tubular duct 11 and an outer tubular sleeve 12 disposed outside and extending along the duct 11 so as to cover openings 13 formed in the cylindrical wall 14 of the inner duct.

The inner duct 11 and the outer sleeve 12 are mounted in respective end pedestals 15, 16 standing up from a base platform 17. More specifically, the ends of duct 11 are seated in clamp rings 18 housed in the end pedestals 15 and end parts of outer sleeve 12 are mounted for rotation in rotary bearings 19 housed in pedestals 16. One end of rotary sleeve 12 is fitted with a drive pulley 21 engaging a V-belt 22 through which the sleeve can be rotated by operation of a geared electric motor 23 mounted on the base platform 17.

Th duct 11 and the outer sleeve 12 are accurately positioned and mounted in the respective end pedestals so that sleeve 12 is very closely spaced about the duct to cover the openings 13 in the duct and the small clearance space between the two is sealed adjacent the ends of the outer sleeve by O-ring seals 24. The inner duct 11 and outer sleeve 12 may be made of stainless steel tubing or other material depending on the nature of the materials to be mixed.

A fluid inlet 25 is connected to one end of the inner duct 11 via a connector 26. The inlet 25 is in the form of a fluid inlet pipe 27 to carry a main flow of fluid and a pair of secondary fluid inlet tubes 28 connected to the pipe 27 at diametrically opposite locations through which to feed a secondary fluid for mixing with the main fluid flow within the mixer. The number of secondary inlet tubes 28 could of course be varied and other inlet arrangements are possible. In a case where two fluids are to be mixed in equal amounts for example, there may be two equal inlet pipes feeding into the mixer duct via a splitter plate. In cases where powders or other materials are to be mixed in a fluid, it would be necessary to employ different inlet arrangements, for example gravity or screw feed hoppers.

The downstream end of duct 11 is connected through a connector 31 to an outlet pipe 32 for discharge of the mixed fluids.

In the mixer illustrated in FIGS. 3 to 7, the openings 13 are in the form of arcuate windows each extending circumferentially of the duct. Each window is of constant width in the longitudinal direction of the duct and the windows are disposed in a array in which successive windows are staggered both longitudinally and circumferentially of the duct so as to form a spiral array along and around the duct. The drawings show the windows arranged at regular angular spacing throughout the length of the duct such that ther is an equal angular separation between successive windows. However, this arrangement can be varied to produce optimum mixing for particular fluids as discussed below.

A mixer of the kind illustrated in FIGS. 3 to 7 has been operated extensively to test flow patterns obtained with varied geometric and flow parameters and to compare these with predictions from numerical simulation and analysis. Because of the possible combinations of $\Delta$, $\Theta$ and $\beta$ define a large parameter space and only certain ranges result in good mixing, numerical modelling has been invaluable in determining suitable parameter choices. The basic procedure to investigate the parameter space is as follows:

(i) Calculate the flow field in the RAM, using one of analytic solutions, two-dimensional CFD modelling or three-dimensional CFD modelling.

(ii) Track a small number of massless "fluid particles" in this flow field and determine Poincaré sections (i.e. the set of points where these massless particles cross the planes located after 1, 2, . . . n apertures). Flows that may potentially mix well will have Poincaré sections in which the point density is evenly distributed across the entire cross section. Poincaré sections from flows that don't mix well will have one or more "islands" in which mixing does not occur efficiently.

(iii) Identify a region in parameter space in which the Poincaré sections are densely filled and in which small changes to the parameters do not adversely effect the mixing.

(iv) Once a promising region in parameter space is found, undertake dye tracing in which a numerical "dye blob" is tracked through the flow. The dye blob consists of a large number of massless fluid particles placed in a small region of the flow (typically 20–100 thousand points).

(v) Design and manufacture a suitable RAM inner cylinder.

The above sequence of design steps may be termed a "dynamical sieve" approach. A more comprehensive explanation of this process is provided in Appendix 1 to this specification.

The two-dimensional flow generated in an aperture by the rotation of the outer cylinder flow field has an analytic solution for a Stokes flow (Re=O) that can be used as a good approximation for the solution in viscous Newtonian fluids. An axial flow profile must also be specified. For higher Reynolds number Newtonian flows or flows of non-Newtonian materials, a coupled solution is required. This can take the form of either a two-dimensional simulation with three components of velocity or a full three-dimensional solution. Full three-dimensional simulation is quite expensive and would only usually be used once a potential region of parameter space has been identified.

The mixer of the kind illustrated in FIGS. 3 to 7 RAM has been optimised for mixing Newtonian fluids at low axial flow Reynolds numbers (less than approximately 25). The optimal values of the parameters for problems of this type are $\Delta=\pi/4$, $\Theta=-3\pi/5$, $\beta=12$, $Z_J=0$. The exact value of H will depend on R, the viscosity of the fluid and the desired through-flow rate. Increasing the parameter N (i.e. the number of windows) will continually improve the mixing at the expense of making the total RAM length longer and the total energy input higher. If the RAM is used in batch mode and fluid is constantly recycling through the RAM, a small number of windows (approximately 6) will be effective. If the RAM is used in an in-line mode and fluid passes through only once, then approximately 10–30 windows will be needed, depending on the desired outcome of the mixing process.

As indicated previously, the parameters specified above are not the only values that will lead to good mixing. For Newtonian flows in which the axial flow Reynolds number is less than approximately 25, the range of good mixing parameters will depend on the chosen $\Delta$. A brief summary of some ranges of acceptable parameters is provid d in the following table.

TABLE 1

Parameter ranges with good mixing for window openings of $\pi/4$ and $\pi/2$. There are other, smaller, subsets of the full parameter space that also result in good mixing.

| $\Delta$ | $\beta$ | $\Theta$ |
|---|---|---|
| $\pi/4$ | $7 < \beta < 15$ | $-2\pi/5 < \Theta < -\pi/5$ |
| | $10 < \beta < 15$ | $-3\pi/5 < \Theta < -\pi/5$ |
| $\pi/2$ | $10 < \beta < 15$ | $2\pi/5 < \Theta < \pi$ |

Worth noting is that the window offsets that provide good mixing for $\pi/4$ have negative values (i.e. $\Theta<0$) and those for $\pi/2$ have positive values (i.e. $\Theta>0$). The total number of windows N required to obtain good mixing an in-line (once through) application will range between 10–30 for all of these parameter values depending on the application and the desired outcome of the mixing process. For all cases, values of $Z_J=0$ are satisfactory except for $\Delta=\pi/2$, $\Theta>4\pi/5$ for which $Z_J=0.2R$ is an acceptable value.

Figure 8A:
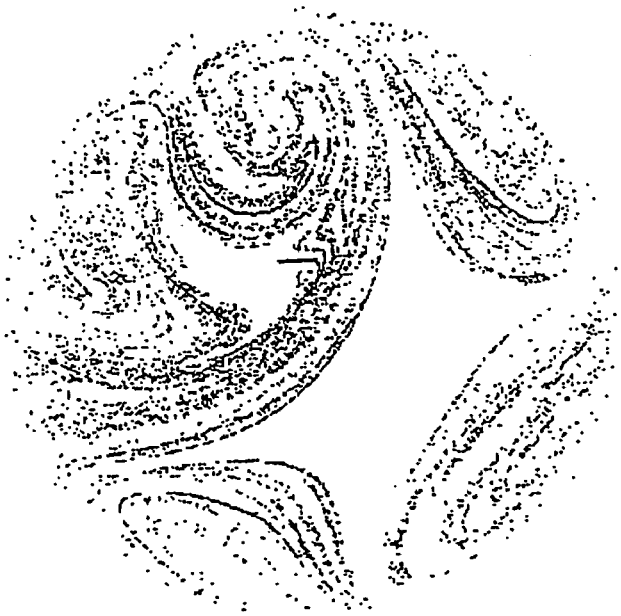
FIG. 8(*a*) depicts the results of a poor choice of parameters, and FIG. 8(*b*) depicts the results of a good selection of parameters.
Figure 8B:
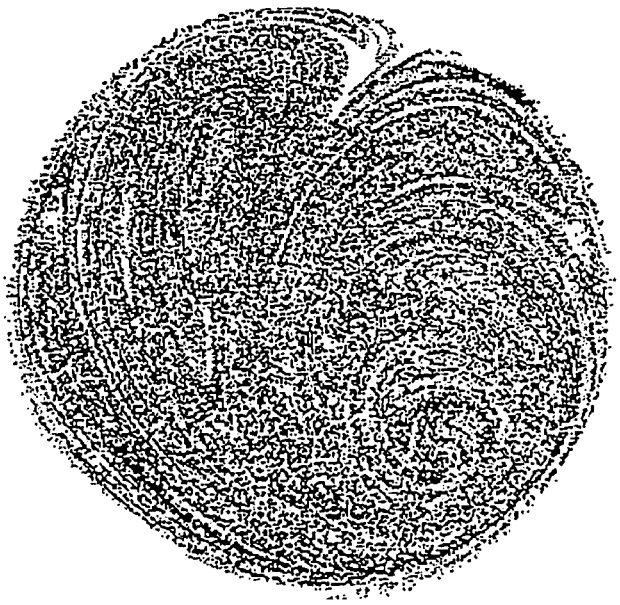
Figure 9:
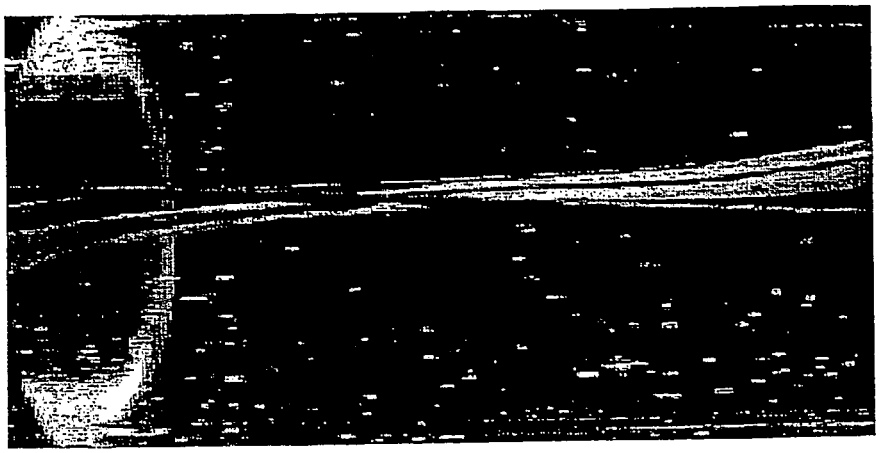
FIG. 9 illustrates the entry of two days streams into a rotated arc mixer.
Figure 10:
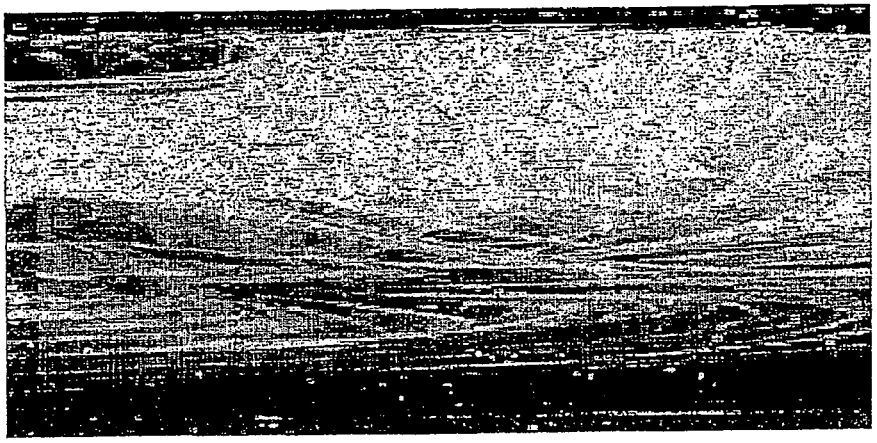
FIG. 10 shows one dye stream that has not mixed at all along the length of a mixer in which parameter selection was poor.
Figure 11:
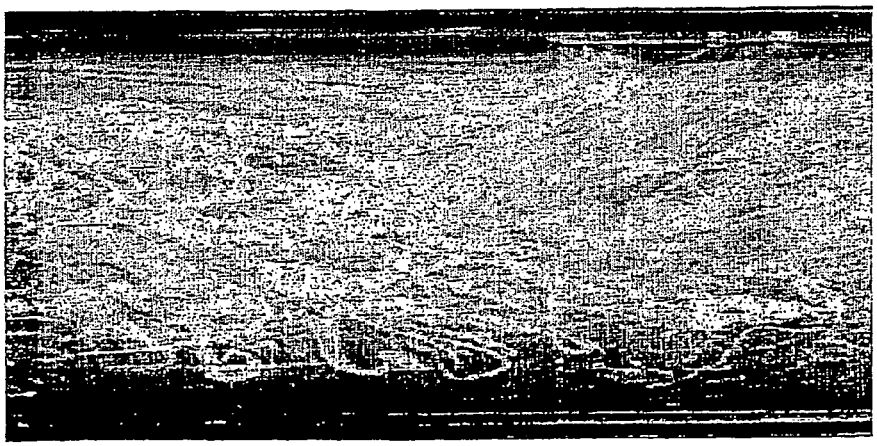
FIG. 11 shows the thorough mixing of dye streams in a mixer in which the selection of parameters is appropriate.

It is important to note that most parameter combinations result in poor mixing, sometimes even parameter sets that lie close to a set which mixes well. Thus an arbitrary choice of parameters is more likely to result in a poor mixer than a good one. This result is highlighted in FIG. 8(*a*) which shows an example for $\Delta=\pi/4$, $\Theta=3\pi/5$ and $\beta=14$. These results were obtained from numerical simulation and show (on the left) a large "island" or region of the flow in which negligible mixing occurs. In contrast, FIG. 8(*b*) is for the case of $\Delta=\pi/4$, $\Theta=-3\pi/5$ and $\beta=14$. A mixer having these parameters mixes well. In order to verify the mixing efficiency of these parameters predicted by simulation, experiments were undertaken with the same parameters. In these experiments, a mixer of the kind illustrated in FIGS. 3 to 7 was constructed with transparent plastic inner and outer tubes and was operated to inject two dye streams into a main fluid flow. The resulting mixing of the two dye streams could be observed and photographed through the transparent tubes. Typical results are shown in FIGS. 9 to 11. FIG. 9 shows the entry of the two dye streams at the inlet end of the mixer. FIG. 10 shows a result in which one dye stream has not mixed at all along the length of the mixer when the parameter selection was poor and FIG. 11 shows thorough mixing of the dye streams when the parameter selection was optimised. The results are shown in FIG. 9, FIG. 10 and FIG. 11.

In some applications (for non-Newtonian fluids in particular), it is desirable to modify the window offset $\Theta$ and/or the window opening $\Delta$ and/or length H in a quasi-periodic manner. For example, after each 4 windows, the window offset is increased by $\Theta_H$for one window only. Similar modifications to the window opening $\Delta$ and/or length H may be required. Thus windows may appear in groups with sequential groups having different values of $\Delta$ and/or H. There is no prescribed methodology for such modifications, and each mixing process must be considered on an individual basis. Moreover, it is not essential to fix the parameters $\Delta$, $\Theta$ and $\beta$ for optimum operation of a single mixer and it is quite possible to design a RAM in which there are successive sequences of windows which have different values of the parameter triplets $\Delta$, $\Theta$ and $\beta$. It is also possible, and may be desirable in some applications to have more than one window at a given axial location and such windows may be of a different size.

The performance of the RAM has been benchmarked against a commonly used static mixer. Some demonstrated characteristics of the RAM are:

It can mix twice as well as an equivalent length static mixer

It has a very much lower pressure drop, (about 7 times lower), than the static mixer It mixes using approximately ⅕ of the total energy of an equivalent length static mixer.

No internal surfaces (baffles, plates, etc.) for material to build up on.

Mixers of the present invention have other advantages over both static mixers and stirred tanks. These are as follows:

It has very low shear, but effective mixing

No large stagnant regions in vessel (this is particularly relevant to stirred tanks in which yield stress and/or shear thinning fluids are being mixed with another material)

Easy to clean

Easier to scale-up designs between laboratory pilot and plant scale than stirred tanks Can be operated to ensure no air is entrained in the mixer Can handle very high viscosity fluids Can be optimized for different fluid rheologies Mixing computations are simpler.

Several potential RAM applications have been identified. The following list is not exhaustive, and the RAM could be potentially utilised in any application in which one or more viscous fluids need to be mixed or in which small gas bubbles, an immiscible liquid, particulates or fibres need to be dispersed in a viscous liquid. Potential applications include:

As a Bio-reactor for viscous fermentations in which high shear may destroy delicate products or reagents.

Polymer blending of two or more viscous polymers.

Pumped explosives in which small prill particles must be mixed in a delicate, but viscous, fuel gel.

As a Crystallizer where high shear may disrupt formation and growth of particles or aggr gates.

In fibrous pulp suspensions in which fibres may clog and block traditional in-line mixer elements.

APPENDIX 1

Algorithm for designing a RAM for a given fluid
The "dynamical sieve" approach The approach taken to design a mixer for a given fluid and application utilises the following sequence of increasingly time-consuming tasks, each of which will reduce the total "volume" of the phase space that needs to be searched in order to define a suitable geometry and operating parameters.

1. Poincaré sections
2. Numerical dye traces
3. Stretching distributions
4. Experimental prototype Steps 1 and 2 are essential steps in the process. Step 3 is useful in choosing between two (or more) apparently good sets of parameters and 4 is recommended for validation purposes. Each step is discussed in some detail below.

1. Poincaré sections

To determine the Poincaré sections for a given set of parameters, a fluid flow velocity field must be obtained for the geometry and flow conditions specified by the parameter choice ($\beta$, $\Delta$, $\Theta$). The velocity field may take one of the following forms:

1. An analytic solution.
2. A numerically calculated two dimensional flow in the cross section of the mixer PLUS an assumed axial flow profile.
3. A numerically determined velocity field calculated on a two-dimensional cross section of the mixer with all three velocity components.
4. A numerically calculated, fully three dimensional velocity field that encompasses the geometry of one window of the mixer and assumes that no additional windows occur ither upstream or down stream.

5. A numerically calculated, fully three dimensional velocity field that encompasses a number of windows, such that the simulation geometry can be periodically extended in the axial direction to give a true and accurate representation of the mixer.

The computational costs involved in each of the 5 options increases down the list. The choice of which option to use is a matter of judgement and is in part determined by how the axial flow and cross-flow interact. For very low Reynolds number Newtonian flow, options 1 or 2 are perfectly satisfactory. For flows in which the axial and cross-sectional flows interact (typical for non-Newtonian fluids) option 3 is necessary, and for flow in which the velocity varies down the length of a window (typical for higher Reynolds number Newtonian flows, visco-elastic flows) option 4 would be necessary. Option 5 is always the best, but is often prohibitively time consuming.

Once a velocity field is chosen, a small number of tracer particles are "placed" in the flow and moved according to the velocity field. Each time a particle reaches an axial position that coincides with the axial position of the end of a window, its position in the cross section is recorded. The picture of dots that is built up after each particle has made many thousands of such crossings is known as a Poincaré section. If the flow is likely to mix well, the Poincaré section will be uniformly dense with dots. If there are regions of the flow that do not mix, they will appear as visible structures in the Poincaré sections, typically "ring"-like structures known in the literature as KAM tori.

Creating Poincaré sections is fairly cheap (computationally), and the first part of the dynamical sieve approach involves determining velocity fields for a large number of different parameter combinations ($\beta$, $\Delta$, $\Theta$) and creating Poincaré sections. The set of sections is searched for regions where neighbouring sections all appear to be well mixed. These are the regions of parameter space that will be searched in more detail.

2. Numerical dye traces

Once a favourable region of parameter space is found, a parameter combination near the "centre" of this region is chosen to undertake a numerical dye trace. A velocity field is required is also required in Step 2. It may be the same as the field used in Step 1, however more accurate results will be obtained by using velocity fields from either option 4 or 5. (Note that for very low Reynolds number flows of Newtonian fluids, any of the options work suitably well). Instead of placing a small number of particles in the flow, a large number (typically 20,000-100,000) are divided into between 2 and 5 different "groups". Each group is placed in a very small region of flow and given a nominal colour. Every particle is then moved according to the velocity field. They continue to be moved until they have passed a fixed number of windows (usually equal to the number believed to be necessary in an operational mixer, although this number generally won't be known until after the simulations have been done). The cross sectional position of the particles as it "exits" the mixer simulation is recorded and the picture constructed from these dots (colour coded by group) allows a realistic picture of the likely mixing to be obtained after a fixed number of windows. If the different coloured particles are uniformly distributed across the cross section, mixing is likely to be good. If some colour particles come out in only a small area of the flow or if large "holes" appear with no particles, then the flow does not mix well.

If this numerical dye trace provides well-mixed results, dye traces in neighbouring points in parameter space will be undertaken to ensure that the region is robust (i.e. not sensitive to small parameter variations). If the region is robust, parameter variations of the fluid will also be made (e.g. yield stress, consistency, power law index), new velocity fields calculated and dye traces repeated to ensure that rheology changes do not adversely affect the mixing performance.

3. Stretching distributions

Stretching distributions give a quantitative estimate of mixing and are a "local" property of each element of fluid as it moves through the flow. They are calculated using equations described in Ottino (The Kinematics of Mixing, Cambridge University Press, 1989). To calculate stretching distributions, a large number of particles (20,000-100,000) are uniformly distributed on a cross-sectional plane and are moved according to the flow velocity field. For each particle, at each step in its motion the stretching equations are solved which gives a quantitative estimate of how much mixing the particle has undertaken. After a fixed number of windows have been passed by each particle, the mean stretching, standard distribution and stretching distribution can be calculated. This process allows the mixing arising from different sets of parameters values to be compared quantitatively and allows a choice to be made between apparently similar dye traces.

4. Experimental prototype

Once a suitable choice of parameters has been determined from Step 2 or Step 3 if desired, an experimental prototype can be constructed and experiments undertaken to confirm the efficacy of mixing.

5. Note on non-uniform ($\beta$, $\Delta$, $\Theta$) triplets

For cases in which non uniform values of the ($\beta$, $\Delta$, $\Theta$) triplet are required for a good mixer, the design protocol is modified slightly. Suitable sets of triplets are chosen as normal from Poincaré sections. Next, a trial sequence of triplets is specified and numerical dye traces must be performed to ensure that the sequence does adequately mix. Stretching distributions and/or experimental trials will proceed as in the case of uniform triplets.

What is claimed is:

1. A mixer comprising:

an elongate hollow body having a peripheral wall surrounding a hollow interior providing a fluid flow passage;

a fluid flow inlet for admission of a fluid and a material to be mixed with that fluid into one end of the fluid flow passage;

a fluid flow outlet for outlet of the mixture from the other end of the fluid flow passage;

a series of openings formed in the peripheral wall of the hollow body;

an outer sleeve closely fitted about and extending along the peripheral wall of the hollow body so as to cover all of said openings and to close the fluid flow passage against flow of fluid to or from the fluid flow passage through the openings;

drive means operable to impart relative motion between the elongate hollow body and the closely fitted sleeve such that there is relative movement between the openings and the peripheral wall of the hollow body and those parts of the sleeve covering the openings in directions across the openings to create viscous drag on the fluid flowing within the fluid flow passage generating transverse peripheral flows of fluid within that passage simultaneously in the vicinity of all of the openings.

2. A mixer comprising:

a cylindrical tubular body having a peripheral wall surrounding a hollow interior providing a fluid flow passage;

a fluid flow inlet for admission of a fluid and a material to be mixed with that fluid into one end of the fluid flow passage within the tubular body;

a fluid flow outlet for outlet of the mixture from the other end of the fluid flow passage within the tubular body;

a series of openings formed in the peripheral wall of the cylindrical tubular body;

an outer sleeve closely fitted about and extending along the peripheral wall of the tubular body so as to cover all of said openings and to close the fluid flow passage within the tubular body against flow of fluid to or from the fluid flow passage through the openings;

drive means operable to impart relative motion between the cylindrical tubular body and the closely fitted sleeve such that there is relative movement between the openings in the peripheral wall of the tubular body and those parts of the sleeve covering the openings in directions across the openings to create viscous drag on the fluid flowing within the fluid flow passage generating transverse peripheral flows of fluid simultaneously in the vicinity of all of said openings whereby to promote mixing of said material in the fluid.

3. A mixer as claimed in claim 2, wherein the outer sleeve is of circular cylindrical form.

4. A mixer as claimed in claim 3, wherein the drive means is operable to impart relative rotation between the cylindrical tubular body and the closely fitted outer sleeve.

5. A mixer as claimed in claim 4, wherein the cylindrical tubular body is static, the sleeve is mounted for rotation about the tubular body and the drive means is operable to rotate the outer sleeve concentrically about the tubular body.

6. A mixer as claimed in claim 2, wherein the openings are in the form of arcuate windows each extending circumferentially of the peripheral wall of the tubular body.

7. A mixer as claimed in claim 6, wherein each window is of constant width in the longitudinal direction of the tubular body.

8. A mixer as claimed in claim 6, wherein the windows are disposed in an array in which successive windows are staggered both longitudinally and circumferentially of the peripheral of the tubular body.

9. A mixer as claimed in claim 8, wherein successive windows overlap one another circumferentially of the tubular wall of the tubular body.

10. A mixer as claimed in claim 9, wherein there is a series of said windows disposed at regular circumferentially angular spacing about the peripheral wall of the tubular wall.

11. A mixer as claimed in claim 10, wherein said series of windows is one of a plurality of such series in which the windows of each series are disposed at equal angular spacing but there is a differing angular spacing between the last window of one series and the first window of a succeeding series.

12. A method of mixing a material in a fluid comprising:

locating a hollow fluid flow tube having a peripheral wall perforated by a series of openings within an outer sleeve closely fitted about and extending along the tube so as to cover the openings and close the tube against flow of fluid to and from the interior of the tube through the openings;

passing fluid and material to be mixed therewith through the interior of the tube;

imparting relative motion between the tube and the sleeve such that there is relative motion between the openings in the peripheral wall of the tube and those parts of the sleeve closing the openings to create viscous drag on fluid flowing through the interior of the tube generating transverse peripheral flows of fluid within the tube simultaneously in the vicinity of all of the openings whereby to promote mixing of said material in the fluid as it flows through the interior of the tube.

13. A method of mixing a material in a fluid comprising:

locating a cylindrical fluid flow tube having a peripheral wall perforated by a series of openings concentrically within a cylindrical inner periphery of an outer cylindrical sleeve closely fitted about and extending along the tube so as to cover the openings and close the tube against flow of fluid to and from the interior of the tube through the openings;

passing fluid and material to be mixed therewith through the interior of the tube;

imparting relative rotation between the tube and the sleeve such that there is relative movement between the openings of the tube and those parts of the sleeve which cover the openings in directions across the openings to create viscous drag on fluid flowing through the tube generating transverse peripheral flows of fluid within the tube simultaneously in the vicinity of all of the openings whereby to promote mixing of said material in the fluid flowing through the tube.

14. A method as claimed in claim 13, wherein the tube is held static and the sleeve is rotated concentrically about it.

15. A method as claimed in claim 13, when said openings are in the form of arcuate windows each extending circumferentially of the fluid flow tube.

16. A method as claimed in claim 13, wherein the windows are of constant width in the longitudinal direction of the fluid flow tube.

17. A method as claimed in claim 16, wherein the windows are disposed in an array in which successive windows are staggered both longitudinally and circumferentially of the fluid flow tube.

18. A method as claimed in claim 17, wherein successive windows overlap one another circumferentially of the fluid flow tube.

19. A method as claimed in claim 17, wherein there is a series of said windows disposed at equal angular spacing about the fluid flow tube.

20. A method as claimed in claim 17, wherein said series is one of plurality of series in which the windows of each series are disposed at equal angular spacing but there is a differing angular spacing between the last window of one series and the first window of a succeeding series.

21. A method as claimed in claim 20, wherein the fluid is a substantially Newtonian fluid.

22. A method as claimed in claim 21, wherein the fluid flow has a Reynolds number of no greater than 25.

* * * * *